US009447511B2

(12) United States Patent
Costentin et al.

(10) Patent No.: US 9,447,511 B2
(45) Date of Patent: Sep. 20, 2016

(54) IRON-BASED CATALYST FOR SELECTIVE ELECTROCHEMICAL REDUCTION OF $CO_2$ INTO CO

(71) Applicants: CENTRE NATIONAL DE LA RECHERCHE SCIENTIFIQUE (CNRS), Paris (FR); UNIVERSITE PARIS DIDEROT PARIS 7, Paris (FR)

(72) Inventors: Cyrille Costentin, Montreuil (FR); Marc Robert, Paris (FR); Jean-Michel Saveant, Paris (FR); Samuel Drouet, Cerences (FR)

(73) Assignees: CENTRE NATIONAL DE LA RECHERCHE SCIENTIFIQUE (CNRS), Paris (FR); UNIVERSITE PARIS DIDEROT PARIS 7, Paris (FR)

( * ) Notice: Subject to any disclaimer, the term of this patent is extended or adjusted under 35 U.S.C. 154(b) by 279 days.

(21) Appl. No.: 14/046,472

(22) Filed: Oct. 4, 2013

(65) Prior Publication Data

US 2015/0096899 A1 Apr. 9, 2015

(51) Int. Cl.
*C25B 1/00* (2006.01)
*C25B 9/06* (2006.01)

(52) U.S. Cl.
CPC .. *C25B 9/06* (2013.01); *C25B 1/00* (2013.01)

(58) Field of Classification Search
CPC ..... C25B 1/00
USPC ..... 205/555
See application file for complete search history.

(56) References Cited

FOREIGN PATENT DOCUMENTS

| | | | |
|---|---|---|---|
| JP | 2003-260364 | A | 9/2003 |
| WO | WO 2011/150422 | A1 | 12/2011 |
| WO | WO 2013/042695 | A1 | 3/2013 |

OTHER PUBLICATIONS

Sonoyama et al., "Electrochemical Reduction of CO2 at Metal-Porphyrin Supported Gas Diffusion Electrodes Under High Pressure CO2," Electrochemistry Communications (no month, 1999), vol. 1, pp. 213-216.*

Hammouche et al., "Chemical Catalysis of Electrochemical Reactions. Homogeneous Catalysis of the Electrochemical Reduction of Carbon Dioxide by Iron("0") Porphyrins. Role of the Addition of Magnesium Cations," J. Am. Chem. Soc. (no month, 1991), vol. 113, pp. 8455-8466).*

Benson et al., "Electrocatalytic and homogeneous approaches to conversion of CO2 to liquid fuels," Chemical Society Reviews, vol. 38, 2009, pp. 88-99.

Bhugun et al., "Catalysis of the Electrochemical Reduction of Carbon Dioxide by Iron(0) Porphyrins: Synergystic Effect of Weak Brönsted Acids," Journal of the American Chemical Society, vol. 118, No. 7, 1996, pp. 1769-1776.

(Continued)

*Primary Examiner* — Edna Wong
(74) *Attorney, Agent, or Firm* — Birch, Stewart, Kolasch & Birch LLP

(57) ABSTRACT

The present invention relates to catalysts for the production of CO gas through electrochemical $CO_2$ reduction. In particular, the present invention relates to an electrochemical cell comprising an iron porphyrin as the catalyst for the $CO_2$ reduction into CO, a method of performing electrochemical reduction of $CO_2$ using said electrochemical cell thereby producing CO gas, and a method of performing electrochemical reduction of $CO_2$ using said iron porphyrin catalyst thereby producing CO gas.

11 Claims, 4 Drawing Sheets
(3 of 4 Drawing Sheet(s) Filed in Color)

$$[(por)Fe(I)]^- + e^- \rightleftharpoons [(por)Fe(0)]^{2-}$$

$$[(por)Fe(0)]^{2-} + CO_2 + 2AH \xrightarrow{k} [(por)Fe(II)CO] + H_2O + 2A^-$$

$$[(por)Fe(II)CO] + [(por)Fe(0)]^{2-} \xrightarrow{k'>>k} 2\,[(por)Fe(I)]^- + CO$$

$$CO_2 + 2AH + 2e^- \longrightarrow CO + H_2O + 2A^-$$

$$\text{if } pK_{(CO_2+H_2O)} << pK_{AH}:$$

$$2A^- + 2(CO_2 + H_2O) \longrightarrow 2AH + 2CO_3H^-$$

$$3\,CO_2 + H_2O + 2e^- \longrightarrow CO + 2CO_3H^-$$

(56) References Cited

OTHER PUBLICATIONS

Bhugun et al., "Ultraefficient selective homogeneous catalysis of the electrochemical reduction of carbon dioxide by an iron(0) porphyrin associated with a weak Brönsted acid cocatalyst," Journal of the American Chemical Society, vol. 116, No. 11, 1994, pp. 5015-5016.
Bhyrappa et al., "Dendrimer-Metalloporphyrins: Synthesis and Catalysis," Journal of the American Chemical Society, vol. 118, No. 24, 1996, pp. 5708-5711.
Bourrez et al., "[Mn(bipyridyl)(CO)3 Br]: An Abundant Metal Carbonyl Complex as Efficient Electrocatalyst for CO2 Reduction," Electrocatalysis, Angewandte Chemie International Edition, vol. 50, 2011, pp. 9903-9906.
Carver et al., "Electrocatalytic Oxygen Reduction by Iron Tetra-arylporphyrins Bearing Pendant Proton Relays," Journal of the American Chemical Society, vol. 134, 2012, pp. 5444-5447.
Chen et al., "Electrocatalytic reduction of CO2 to CO by polypyridyl ruthenium complexes," Chemical Communications, vol. 47, 2011, pp. 12607-12609.
Costentin et al., "Catalysis of the electrochemical reduction of carbon dioxide," Chemical Society Reviews, vol. 42, 2013, pp. 2423-2436.
Costentin et al., "Turnover Numbers, Turnover Frequencies, and Overpotential in Molecular Catalysis of Electrochemical Reactions. Cyclic Voltammetry and Preparative-Scale Electrolysis," Journal of the American Chemical Society, vol. 134, 2012, pp. 11235-11242.
Costentin et al., Supporting Information, "Turnover Numbers, Turnover Frequencies, and Overpotential in Molecular Catalysis of Electrochemical Reactions. Cyclic Voltammetry and Preparative-Scale Electrolysis," Journal of the American Chemical Society, vol. 134, 2012, pp. 1S-6S.
Fang et al., "A Four-Coordinate Fe(III) Porphyrin Cation," Journal of the American Chemical Society, vol. 130, No. 4, 2008, pp. 1134-1135.
Fang et al., Supporting Information, "A Four-Coordinate Fe(III) Porphyrin Cation," Journal of the American Chemical Society, vol. 130, No. 4, 2008, pp. S1-S8.
Froehlich et al., "Homogeneous CO2 Reduction by Ni(cyclam) at a Glassy Carbon Electrode," Inorganic Chemistry, vol. 51, 2012 (Published: Mar. 21, 2012), pp. 3932-3934.
Hawecker et al., "Electrocatalytic reduction of carbon dioxide mediated by Re(bipy)(CO)3CI(bipy=2,2'-bipyridine)," Journal of the Chemical Society, Chemical Communications, 1984, pp. 328-330.
Raebiger et al., "Electrochemical Reduction of CO2 to CO Catalyzed by a Bimetallic Palladium Complex," Organometallics, vol. 25, 2006, pp. 3345-3351.
Savéant, "Molecular Catalysis of Electrochemical Reactions. Mechanistic Aspects," Chemical Reviews, vol. 108, No. 7, 2008, pp. 2348-2378.
Costentin et al., "A Local Proton Source Enhances CO2 Electroreduction to CO by a Molecular Fe Catalyst", www.sciencemag.org, Oct. 5, 2012, vol. 338, pp. 90-94.

* cited by examiner $$[(por)Fe(I)]^{-} + e^{-} \rightleftharpoons [(por)Fe(0)]^{2-}$$

$$[(por)Fe(0)]^{2-} + CO_2 + 2AH \xrightarrow{k} [(por)Fe(II)CO] + H_2O + 2A^{-}$$

$$[(por)Fe(II)CO] + [(por)Fe(0)]^{2-} \xrightarrow{k'>>k} 2\,[(por)Fe(I)]^{-} + CO$$

$$CO_2 + 2AH + 2e^{-} \longrightarrow CO + H_2O + 2A^{-}$$

$$\text{if } pK_{(CO_2 + H_2O)} << pK_{AH}:$$

$$2A^{-} + 2(CO_2 + H_2O) \longrightarrow 2AH + 2CO_3H^{-}$$

$$3\,CO_2 + H_2O + 2e^{-} \longrightarrow CO + 2CO_3H^{-}$$

IRON-BASED CATALYST FOR SELECTIVE ELECTROCHEMICAL REDUCTION OF $CO_2$ INTO CO

TECHNICAL FIELD

The present invention relates to catalysts for the production of CO gas through electrochemical $CO_2$ reduction. In particular, the present invention relates to an electrochemical cell comprising an iron porphyrin as the catalyst for the $CO_2$ reduction into CO, a method for performing electrochemical reduction of $CO_2$ using said electrochemical cell thereby producing CO gas, and a method for performing electrochemical reduction of $CO_2$ using said iron porphyrin catalyst thereby producing CO gas.

BACKGROUND OF THE INVENTION

Despite the increasingly frequent use of renewable energies to produce electricity avoiding concomitant production of $CO_2$, it is reasonable to consider that $CO_2$ emissions, in particular resulting from energy production, will remain high in the next decades. It thus appears necessary to find ways to capture $CO_2$ gas, either for storing or valorization purposes.

Indeed, $CO_2$ can also be seen, not as a waste, but on the contrary as a source of carbon. For example the promising production of synthetic fuels from $CO_2$ and water has been envisaged.

However, $CO_2$ exhibits low chemical reactivity: breaking its bonds requires an energy of 724 kJ/mol. Moreover, $CO_2$ electrochemical reduction to one electron occurs at a very negative potential, thus necessitating a high energy input, and leads to the formation of a highly energetic radical anion ($CO_2.^-$); catalysis thus appears mandatory in order to reduce $CO_2$ and drive the process to multi-electronic and multi-proton reduction process, in order to obtain thermodynamically stable molecules. In addition, direct electrochemical reduction of $CO_2$ at inert electrodes is poorly selective, yielding to formic acid in water, while it yields a mixture of oxalate, formate and carbon monoxide in low-acidity solvents such as DMF.

Electrolysis is a method of applying a potential at an immersed electrode to drive an otherwise non-spontaneous electrochemical reaction. Electrolysis is performed in an electrochemical cell, comprising at least:

- an electrolyte solution comprising the solvent, a supporting electrolyte as a salt, and the substrate
- a power supply providing the energy necessary to trigger the electrochemical reactions involving the substrate; and
- two electrodes, i.e. electrical conductors providing a physical interface between the electrical circuit and the solution.

$CO_2$ electrochemical reduction requires catalytic activation in order to reduce the energy cost of processing, and increase the selectivity of the species formed in the reaction process.

Such systems require a complex molecular machinery and only a few homogeneous catalysts have been described to date, and they are almost exclusively based on quite expensive rare metals.

Homogeneous or heterogeneous catalysts based on transition metals of the first line (Mn, Fe, Co, Ni, Cu), which appear preferable because of their availability and low cost, are also used for the reduction of $CO_2$. However, whether these metals are used in the form of a complex, as e.g. complexes of porphyrin, phthalocyanine, polypyridine, or cyclam, the resulting catalysts are less efficient than their counterparts based on transition metals of the second and third lines (Ru, Rh, Pd, Re, Pt, . . . ) (for a review see Savéant *Chem. Rev.* 2008, 108, 2348-2378).

In particular, iron porphyrins have been previously described, but their catalytic properties regarding the electrochemical reduction of $CO_2$ into CO were rather poor (see for instance JP 2003-260364 and WO 2011/150422). Bhugun et al (see in particular *J. Am. Chem. Soc.* 1994, 116, 5015-5016 and *J. Am. Chem. Soc.* 1996, 118, 1769-1776) however demonstrated that the selectivity and TON (see definition below) of the iron porphyrin catalysts, such as in particular Fe-TPP (5,10,15,20-tetrakisphenylporphyrine), are significantly increased when adding either a Lewis acid or a Brönsted acid to the electrolyte solution. Said acid indeed acts as a synergistic factor with the catalyst. However, the mechanism of action of said acid remains to be precisely determined. Moreover, when the acid strength increases, it may result in a loss of selectivity and a progressive deterioration of the catalyst.

There thus remains a strong need for catalysts for the electrochemical reduction of $CO_2$ into CO based on iron porphyrin with high efficiency (i.e. high faradic yield, high Turnover Number (TON) and Turnover Frequency (TOF)), high selectivity and high stability, while if possible operating at a low overpotential.

SUMMARY OF THE INVENTION

The present invention thus relates to the use as a catalyst for the production for CO gas through electrochemical $CO_2$ reduction of a compound of formula (I):

(I)

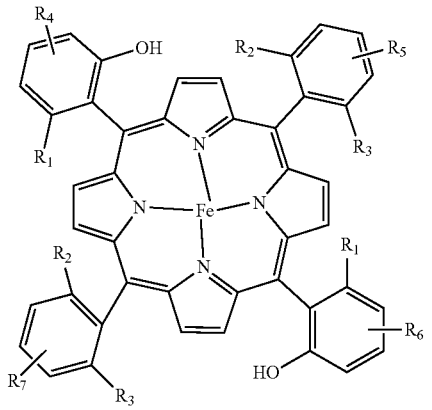

wherein

R1 represents OH, or $C_1$-$C_4$-alcohol,

R2, R3, R4, R5, R6 and R7 independently represent H, OH, or $C_1$-$C_4$-alcohol, and Fe represents either Fe (0), Fe(I), Fe(II) or Fe(III)

The compound of formula (I) is synthesized and introduced in an electrochemical cell as the chloride of the Fe(III) complex. However, during the electrochemical process, the iron atom is first reduced to Fe(0) and all oxidation states Fe(0), Fe(I) and Fe(II) are successively involved during the catalytic cycle of the $CO_2$ reduction into CO.

It is thus understood that, in formula (I), Fe represents either Fe(0), Fe(I), Fe(II) or Fe(III).

In particular, the present invention provides an electrochemical cell comprising an iron porphyrin as the catalyst for the $CO_2$ reduction into CO.

The present invention further provides a method for performing electrochemical reduction of $CO_2$ using said electrochemical cell thereby producing CO gas.

The invention further provides a method for performing electrochemical reduction of $CO_2$ using said iron porphyrin catalyst thereby producing CO gas.

BRIEF DESCRIPTION OF THE DRAWINGS

The patent or application file contains at least one color drawing. Copies of this patent or patent application with color drawings will be provided by the USPTO upon request and payment of the necessary fee.

DETAILED DESCRIPTION OF THE INVENTION

Figures 1, 2:
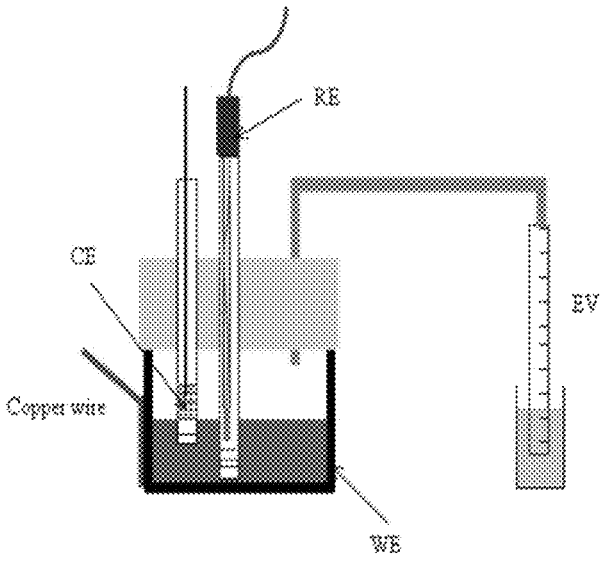
FIG. 1: Simplified reaction scheme for $CO_2$ reduction by iron(0) porphyrins
FIG. 2: Scheme depicting a typical electrochemical cell. WE: carbon crucible working electrode, CE: platinum grid counter-electrode, RE: aqueous saturated calomel electrode, EV: expansion vessel.

The headings (such as "Introduction" and "Summary,") used herein are intended only for general organization of topics within the disclosure of the invention, and are not intended to limit the disclosure of the invention or any aspect thereof.

As used herein, the words "preferred" and "preferably" refer to embodiments of the invention that afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein, the words "include," "comprise," "contain", and their variants, are intended to be non-limiting, such that recitation of items in a list is not to the exclusion of other like items that may also be useful in the materials, compositions, devices, and methods of this invention.

According to the present invention, "overpotential (η)" is understood as a potential difference between the thermodynamic reduction potential of the $CO_2$/CO couple ($E°_{A/C}$) and the potential at which the reduction is experimentally observed (E), according to the following equation: $\eta = E°_{A/C} - E$.

According to the present invention, the "TurnOver Number (TON)" represents the number of moles of substrate that a mole of active catalyst can convert.

According to the present invention, the "TurnOver Frequency (TOF)" refers to the turnover per unit of time:

$$TOF = \frac{TON}{t},$$

with t representing the time of catalysis.

According to the present invention, "$TOF_0$" represents the TurnOver Frequency at zero overpotential. The value of $TOF_0$ is obtained from extrapolation of the TOF vs. overpotential curve at zero overpotential. The TOF vs. overpotential curve is obtained from the experimental measurement of the current density (I) as function of potential (E) using cyclic voltammetry and using the following relationship:

$$TOF = \frac{I}{F\sqrt{\frac{D}{k_{cat}}}\,C^0_{cat}}$$

with D being the diffusion coefficient of the catalyst, $C_{cat}^0$ being its concentration in solution and $k_{cat}$ the catalytic rate constant. The value of $TOF_0$ is preferably calculated as detailed in Costentin et al, Science 338, 90 (2012), the content of which is incorporated herein by reference.

The faradic yield of an electrochemical cell aimed at producing CO gas through electrochemical reduction of $CO_2$ gas is the ratio of the amount of electrons (in Coulomb) used to produce CO gas relative to the amount of electrons (in Coulomb) furnished to the electrochemical system by the external electric source.

According to the present invention, a "homogeneous catalyst" is a catalyst which is contained in the same phase as the reactants. In contrast, a heterogeneous catalyst is contained in a phase which differs from the phase of the reactants. Therefore, in the present invention, a "homogeneous catalyst" is soluble in electrochemical cell solution. In particular, homogeneous catalyst of the invention is soluble in DMF (N,N-dimethylformamide), ACN (acetonitrile) and mixtures thereof, in particular mixtures of ACN and water, and mixtures of DMF and water.

In particular, the present invention concerns an electrochemical cell comprising at least an anode, a cathode, a source of gaseous $CO_2$, an electrolyte solution and the porphyrin of formula (I)

(I)

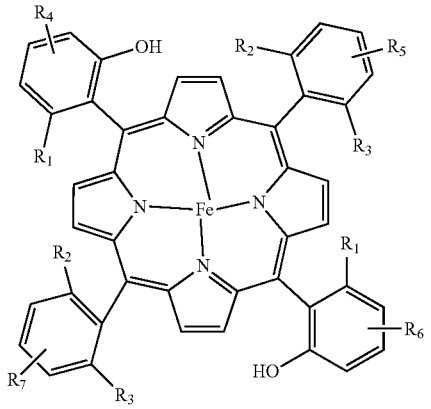

wherein

R1 represents OH, or $C_1$-$C_4$-alcohol,

R2, R3, R4, R5, R6 and R7 independently represent H, OH, or $C_1$-$C_4$-alcohol, Fe represents either Fe(0), Fe(I), Fe(II) or Fe(III).

The $C_1$-$C_4$ alcohol may be linear or branched, saturated or unsaturated. Preferably, said $C_1$-$C_4$ alcohol is unsaturated. Examples of $C_1$-$C_4$ alcohol are hydroxymethyl, 1-hydroxyethyl, 2-hydroxyethyl, 1-hydroxypropyl, 2-hydroxypropyl, 3-hydroxypropyl, 1hydroxy-1-methylethyl, 1-hydroxybutyl, 2-hydroxybutyl, 3-hydroxybutyl, 4-hydroxybutyl, 1hydroxy-1-methylpropyl, 1-hydroxy-2-methylpropyl, 2-hydroxy-1-methylpropyl, 2-hydroxy-2-methylpropyl.

The present invention also encompasses the porphyrin of formula (I) in the form of a salt where appropriate, or of a solvate.

Advantageously, the anode is a conductive electrode. Preferably, the anode is a carbon or platinum electrode. More preferably, the anode is a platinum electrode, in particular a platinum wire.

Advantageously, the cathode is a carbon, mercury, iron, silver, or gold electrode. Preferably, it is a carbon electrode, such as a carbon crucible or glassy carbon.

In a particular embodiment, the electrochemical cell further comprises a third electrode, preferably a reference electrode such as a standard calomel electrode or a silver chloride electrode.

Advantageously, the electrolyte solution comprises the porphyrin of formula (I).

In one embodiment, the porphyrin of formula (I) is in a concentration, in the electrolyte solution, of between 0.0005 and 0.01 M, preferably 0.001 M.

Advantageously, the electrolyte solution comprises DMF (dimethylformamide) or ACN (acetonitrile). In particular, the electrolyte solution is a solution of water in DMF, preferably a 0-5.0 M solution of water in DMF, more preferably 0-2.5 M solution of water in DMF, even more preferably 1.0-2.0 M solution of water in DMF. The electrolyte solution may further contain salts as the supporting electrolyte, such as n-$NBu_4PF_6$, or NaCl for example. The electrolyte solution may further contain additives such as $Et_2NCO_2CH_3$ for instance.

In one embodiment the electrochemical cell comprises one compartment.

In another embodiment the electrochemical cell comprises several compartments, preferably two compartments. In particular, one compartment contains the anode, and this compartment is bridge separated from the cathodic compartment by a glass frit. In this embodiment, the anodic and cathodic compartments contain two different electrolytes. Preferably, the electrolyte of the cathodic compartment is a solution of $Et_2NCO_2CH_3$ and 0.1 M n-$NBu_4PF_6$ in DMF. Advantageously, in this case $Et_2NCO_2CH_3$ is in a concentration of between 0.01 and 1 M, preferably 0.1 and 0.5 M, even more preferably 0.4 M, and n-$NBu_4PF_6$ is in a concentration of between 0.01 and 1 M, preferably 0.01 and 0.5 M, even more preferably 0.1 M.

In one embodiment, the electrochemical cell of the invention is saturated with $CO_2$ gas, that is to say, both the atmosphere and the electrolyte solution are saturated with $CO_2$.

In an advantageous embodiment, R1 represents OH. The compound of formula (I) is thus best represented by the compound of formula (II):

(II)

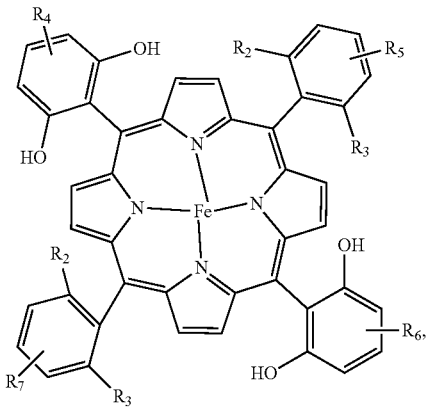

wherein R2 to R7, and Fe are as described above.

In an advantageous embodiment, R2 represent OH. The compound of formula (I) is thus best represented by the compound of formula (III):

(III)

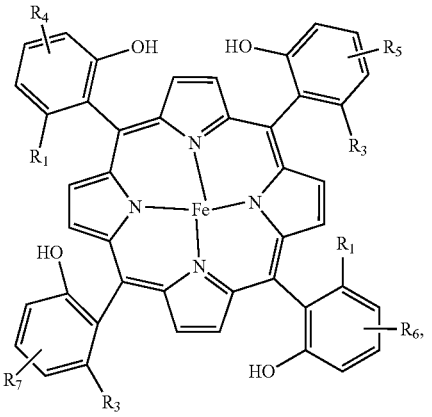

wherein R1 and R3 to R7, and Fe are as described above.

In a preferred embodiment, R1, R2 and R3 represent OH. The compound of formula (I) is thus best represented by the compound of formula (IV):

(IV)

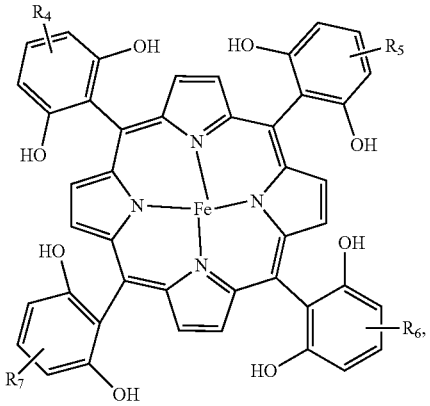

wherein R4 to R7, and Fe are as described above.

In a more preferred embodiment, said porphyrin of formula (I) is $Fe^0$TDHPP

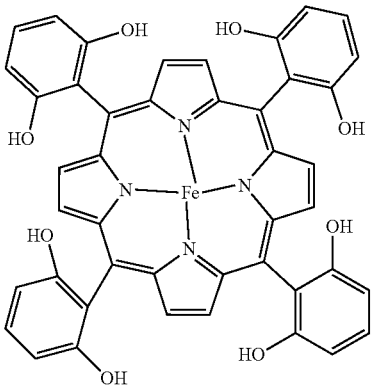

The compound of formula (I) preferably has a $TOF_0$ greater than $10^{-10}$ $s^{-1}$, preferably greater than $10^{-8}$ $s^{-1}$, more preferably greater than $10^{-6}$ $s^{-1}$.

The present invention further concerns a method comprising performing electrochemical reduction of $CO_2$ using the electrochemical cell of the present invention, thereby producing CO gas.

Advantageously, the potential applied to the cathode is between −2.5 V and −0.5 V versus NHE, more advantageously between −2.0 V and −0.5 V versus NHE, more advantageously between −1.5 V and −0.8 V versus NHE, more advantageously between −1.3 V and −1.0 V versus NHE.

Advantageously, the intensity applied to the cathode is between 2 and 5 A/$m^2$, more preferably between 2.5 and 4 A/$m^2$, even more preferably between 3 and 3.5 A/$m^2$.

Preferably, the method of the invention is carried out at a temperature between 15 and 30° C., more preferably, between 20 and 25° C.

The faradic yield of the method is preferably comprised between 80% and 99%, in particular between 84% and 99%, or between 90% and 99%, or more preferably between 94 and 99%. Therefore, the method of the present invention allows for a clean conversion of $CO_2$ into CO, producing only minimal amounts of undesired byproducts, such as in particular $H_2$. In general, no formation of formic acid or formate are observed. The only by-product is generally $H_2$.

In one embodiment, the electrochemical cell is used as a closed system regarding $CO_2$ gas. In a yet preferred embodiment, the method of the invention is carried out with a stream of $CO_2$. Preferably, said stream allows for saturating the electrolyte solution as well as the electrochemical cell atmosphere. It is of note that CO is typically not soluble in the electrolyte solution, so that it is collected directly as a gas.

The present invention further concerns a method comprising performing electrochemical reduction of $CO_2$ thereby producing CO gas, using the porphyrin of formula (I):

(I)

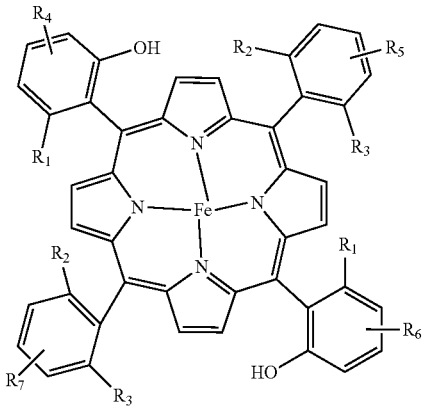

wherein

R1 to R7, and Fe are as described above, as a catalyst in an electrochemical cell for said electrochemical reduction of $CO_2$ into CO.

Preferably, the porphyrin of formula (I) is in a concentration, in the electrolyte solution, of between 0.0005 and 0.01 M, preferably 0.001 M. Advantageously, the potential applied to the cathode is between −2.0 V and −0.5 V versus NHE, more advantageously between −2.0 V and −0.5 V versus NHE, more advantageously between −1.5 V and −0.8 V versus NHE, more advantageously between −1.3 V and −1.0 V versus NHE.

Advantageously, the intensity applied to the cathode is between 2 and 5 A/$m^2$.

Preferably, the method of the invention is carried out at a temperature between 15 and 30° C., more preferably, between 20 and 25° C.

The faradic yield of the method is preferably comprised between 80% and 99%, in particular between 84% and 99%. Therefore, the method of the present invention allows for a clean conversion of $CO_2$ into CO, producing only minimal amounts of undesired byproducts, such as in particular $H_2$. In general, no formation of formic acid or formate are observed.

This method may be performed in an electrochemical cell. In one embodiment, the electrochemical cell is used as a closed system regarding $CO_2$ gas. In a yet preferred embodiment, the method of the invention is carried out with a stream of $CO_2$. Preferably, said stream allows for saturating the electrolyte solution as well as the electrochemical cell atmosphere. It is of note that CO is typically not soluble in the electrolyte solution, so that it is collected directly as a gas.

The presence of the hydroxyl ortho substituents is of capital importance in the catalytic process. Indeed, as demonstrated in example 4, the presence of ortho hydroxy groups seems to be responsible for the enhancement of the catalytic performance (see comparison with catalysts Fe(0) TPP and Fe(0)TDMPP).

Moreover, the catalytic performances of the catalysts of the present invention, in particular in terms of TOF and overpotential, are superior to known existing molecular calatysts for the electrochemical reduction of $CO_2$ gas into CO. In the prior art, high efficiency (especially in terms of TON, TOF and η) could not be obtained despite the use of catalysts based on transition metals of the second and third line to obtain such efficiency, whereas the catalysts of the invention are simply based on iron, a cheap and widely available metal. Moreover the catalysts of the present invention exhibit high selectivity.

Therefore, the electrochemical cells as well as the methods of the present invention are advantageous over the prior art.

Although the invention has been described above with respect to various embodiments, including those believed the most advantageous for carrying out the invention, it is to be understood that the invention is not limited to the disclosed embodiments. Variations and modifications that will occur to one of skill in the art upon reading the specification are also within the scope of the invention, which is defined in the appended claims.

The description and specific examples, while indicating embodiments of the invention, are intended for purposes of illustration only and are not intended to limit the scope of the invention. Moreover, recitation of multiple embodiments having stated features is not intended to exclude other embodiments having additional features, or other embodiments incorporating different combinations of the stated features. Specific Examples are provided for illustrative purposes of how to make, use and practice the electrochemical cells and methods of this invention and, unless explicitly stated otherwise, are not intended to be a representation that given embodiments of this invention have, or have not, been made or tested.

EXAMPLES

Chemicals. Dimethylformamide (Sigma-Aldrich, >99.8%, over molecular sieves), the supporting electrolyte n-$NBu_4PF_6$ (Fluka, purriss.). All starting materials were obtained from Sigma-Aldrich, Fluka and Alfa-aesar, used without further purification. MeOH, $CHCl_3$, $CH_2Cl_2$ were distilled from calcium hydride and stored under an argon atmosphere. $^1$H NMR spectra were recorded on a Bruker Avance III 400 MHz spectrometer and were referenced to the resonances of the solvent used. The mass spectra were recorded on a Microtof-Q of Bruker Daltonics.

Example 1

Synthesis of Chloro iron (III) 5,10,15,20-tetrakis(2',6'-dihydroxyphenyl)-porphyrin (Fe-TDHPP) [3]

Synthesis of 5,10,15,20-tetrakis(2',6'-dimethoxyphenyl)-21H,23H-porphyrin [1]

A solution of 2'-6'-dimethoxybenzaldehyde (1 g, 6.02 mmol) and pyrrole (0.419 mL, 602 mmol) in chloroform (600 mL) was degassed by argon for 20 minutes, then $BF_3.OEt_2$ (0.228 mL, 0.87 mmol) was added via a syringe. The solution was stirred at room temperature under inert atmosphere in the dark for 1.5 hours, and 2,3-dichloro-5,6-dicyano-1,4-benzoquinone (DDQ) (1.02 g, 4.51 mmol) was added to the reaction. The mixture was stirred for an additional 1.5 hours at reflux, cooled to room temperature, and 1 mL of triethylamine was added to neutralize the excessive acid. Then the solvent was removed, and the resulting black solid was purified by column chromatography (silica gel, dichloromethane) affording porphyrin 1 as a purple powder (290 mg, 23%). $^1$H NMR (400 MHz, $CDCl_3$): δ 8.59 (s, 8H), 7.60 (t, J=8 Hz, 4H), 6.89 (d, J=8 Hz, 8H), 3.41 (s, 24H), −2.57 (s, 2H). HRESI-MS ($[M+H]^+$) calcd for $C_{52}H_{47}N_4O_8$ 855.3388, found 855.3358.

Synthesis of 5,10,15,20-tetrakis(2',6'-dihydroxyphenyl)-21H,23H-porphyrin [2]

To a solution of porphyrin 1 (400 mg, 0.47 mmol) in dry dichloromethane (25 mL) at −20° C. was added $BBr_3$ (451 μL, 4.68 mmol). The resulting green solution was stirred for 12 hours at room temperature, then placed in ice water, ethyl acetate was added to the suspension and the mixture was washed with $NaHCO_3$. The organic layer was separated, washed twice with water and then dried over anhydrous $Na_2SO_4$. The resulting solution was evaporated. The residue was purified by column chromatography (silica gel, 20:1 ethyl acetate/methanol) to yield porphyrin 2 as a purple powder (300 mg, 87%). $^1$H NMR (400 MHz, MeOD): δ 8.81 (s, 8H), 7.38 (t, J=8 Hz, 4H), 6.72 (d, J=8 Hz, 8H). HRESI-MS ($[M+H]^+$) calcd for $C_{44}H_{31}N_4O_8$ 743.2436, found 743.2136.

Synthesis of Chloro iron (III) 5,10,15,20-tetrakis(2',6'-dihydroxyphenyl)-porphyrin [3]

A solution of compound [2] (200 mg, 0.27 mmol), anhydrous iron (II) bromide (1.04 g, 4.85 mmol) and 2,6-lutidine (78 μL, 0.67 mmol) was heated at 50° C. and stirred 3 hours under inert atmosphere in dry methanol. After methanol was removed, the resulting solid was dissolved in ethyl acetate, washed with 1.2 M HCl solution and then washed until pH was neutral. The crude product was purified by column chromatography (silica gel, 1:1 methanol/ethyl acetate) to give compound 3 as a brown solid (211 mg, 94%). HRESI-MS ($[M]^+$) calcd for $C_{44}H_{28}FeN_4O_8$ 796.1242, found 796.1252.

Example 2

Synthesis of Chloro iron (III) 5,10,15,20-tetrakis(2',6'-dimethoxyphenyl)-porphyrin (FeTDMPP) [4]

Synthesis of Chloro iron (III) 5,10,15,20-tetrakis(2',6'-dimethoxyphenyl)-porphyrin [4]

A mixture of [1] (90 mg, 0.105 mmol), anhydrous iron (II) bromide (227 mg, 1.053 mmol) and anhydrous dimethylformamide (23 ml) was refluxed under inert conditions for 2 hours, opened to air and brought to dryness under vacuum. The residue was re-dissolved in dichloromethane, washed with water. The organic layer was stirred with 20% HCl for 75 min, washed with water and taken to dryness. The residue was purified using column chromatography (silica gel, dichloromethane to 1% methanol/dichloromethane), re-dissolved in dichloromethane and stirred with 4N HCl for 1 h.

The organic layer was separated, washed with water and dried over $Na_2SO_4$ and evaporated to furnish 4 as a brown solid (60 mg, 54%). HRESI-MS ($[M]^+$) calcd for $C_{52}H_{44}FeN_4O_8$ 908.2469, found 908.2504.

Example 3

Measurements

All the results presented herein have been previously described in Science 2012, 338, 90-94 et Chem. Soc. Rev. 2013, 42, 2423, the content of which is incorporated herein in its entirety, including the supporting information.

Methods and Instrumentation

Cyclic Voltammetry. The working electrode was a 3 mm-diameter glassy carbon (Tokai) disk carefully polished and ultrasonically rinsed in absolute ethanol before use. For scan rate above 0.1 V/s the working electrode was a 1 mm-diameter glassy carbon rod obtained by mechanical abrasion of the original 3 mm-diameter rod. A mercury drop hung to a 1 mm diameter gold disk was also used as working electrode to determine the FeTDHPP standard potential. The counter-electrode was a platinum wire and the reference electrode an aqueous Standard Calomel Electrode (SCE electrode). All experiments were carried out under argon or carbon dioxide at 21° C., the double-wall jacketed cell being thermostated by circulation of water. Cyclic voltammograms were obtained by use of a Metrohm AUTOLAB instrument. Ohmic drop was compensated using the positive feedback compensation implemented in the instrument.

Electrolysis. Electrolyses were performed using a Princeton Applied Research (PARSTAT 2273) potentiostat. The experiments were carried out in a cell (FIG. 2) with a carbon crucible as working electrode (S=20 $cm^2$), the volume of the solution is 10 mL. The reference electrode was an aqueous Standard Calomel Electrode (SCE electrode) and the counter electrode a platinum wire in a bridge separated from the cathodic compartment by a glass frit, containing a 0.4M $Et_2NCO_2CH_3$+0.1 M n-$NBu_4PF_6$ DMF solution. The electrolysis solution was purged with $CO_2$ during 20 min prior to electrolysis.

Ohmic drop was minimized as follows: the reference electrode was directly immerged in the solution (without separated bridge) and put progressively closer to the working electrode until oscillations appear. It is then slightly moved away until the remaining oscillations are compatible with recording of the catalytic current-potential curve. The appearance of oscillations in this cell configuration does not require positive feedback compensation as it does with micro-electrodes. The potentiostat is equivalent to a self-inductance. Oscillations thus appear as soon as the resistance that is not compensated by the potentiostat comes close to zero as the reference electrode comes closer and closer to the working electrode surface.

Gaz Detection. Gas chromatography analyses of gas evolved in the course of electrolysis were performed with a HP 6890 series equipped with a thermal conductivity detector (TCD). CO and $H_2$ production was quantitatively detected using a carbosieve 5 III 60-80 Mesh column 2 m in length and ⅛ inch in diameter. Temperature was held at 230° C. for the detector and 34° C. for the oven. The carrier gas was helium flowing at constant pressure with a flow of 20 mL/min. Injection was performed via a syringe (500 μL) previously degazed with $CO_2$. The retention time of CO was 7 min. Calibration curves for $H_2$ and CO were determined separately by injecting known quantities of pure gas.

Cyclic Voltammetry of $Fe^{III}$TDMPP

Figure 3:
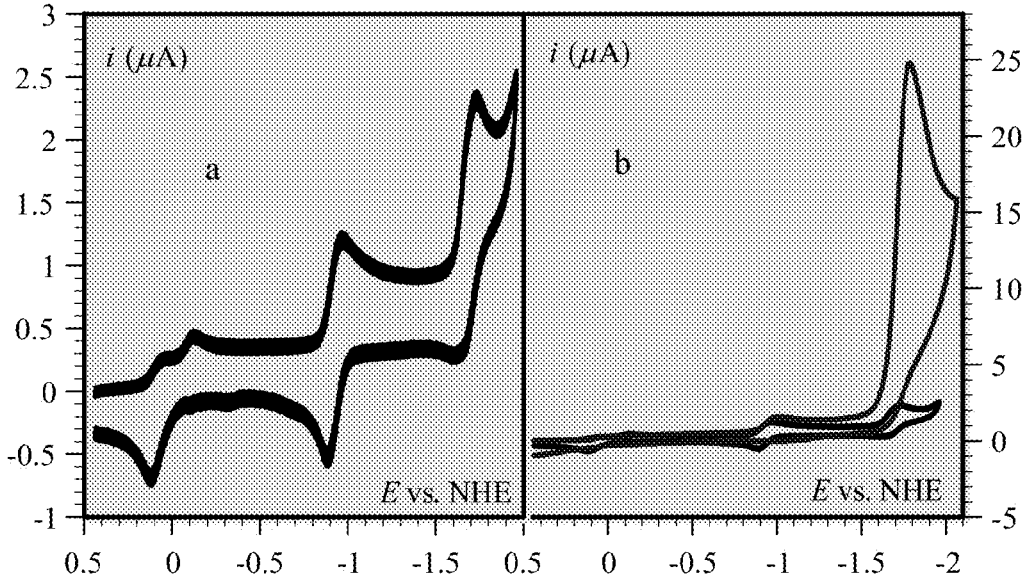
FIG. 3: Results of Cyclic voltammetry (intensity in μA as a function of E vs NHE in V) of 1 mM $Fe^{III}$TDMPP in DMF+0.1 M n-$Bu_4NPF_6$+2M $H_2O$, at 0.1 V/s in the absence (a) and presence (b) of 0.23 M $CO_2$, after normalization toward the $Fe^{II}/Fe^{I}$ peak current, $i^0_p$.

The results of the cyclic voltammetry measurements of 1 mM $Fe^{III}$TDMPP in DMF+0.1 M n-$Bu_4NPF_6$+2M $H_2O$, at 0.1 V/s in the absence (a) and presence (b) of 0.23 M $CO_2$, after normalization toward the $Fe^{II}/Fe^{I}$ peak current, $i^0_p$, are depicted in FIG. 3. The obtained results show that $Fe^{III}$TDMPP is a catalyst for $CO_2$ reduction at the level of Fe(0)/Fe(I) wave.

Standard Potentials and Standard Rate Constants of $Fe^{I/0}$TDHPP and $Fe^{I/0}$ TDMPP In all experiments, the $Fe^{II/I}$ wave serves as an internal standard. The corresponding standard potential for $Fe^{II/I}$ TDHPP is −0.918 V vs. NHE. At low scan rate the $Fe^{I/0}$ TDHPP wave is chemically irreversible. High scan rate cyclic voltammograms were thus recorded on a mercury drop electrode. Simulation using DigiElch software allows the determination of $E_{Fe^{I/0}TDHPP}{}^0$=−1.333 V vs. NHE and $\sqrt{D}/k_S$=0.029 $s^{1/2}$ (FIG. 3).

At low scan rate the $Fe^{I/0}$TDMPP wave is chemically irreversible. Raising the scan rate on a 1 mm-diameter glassy carbon electrode allows to restore reversibility. Simulation allows to determine $E_{Fe^{I/0}TDMPP}{}^0$=−1.69 V vs. NHE and $\sqrt{D}/k_S$=0.043 $s^{1/2}$ (FIG. 3*b*).

Therefore, these experiments demonstrate that $Fe^{I/0}$ TDMPP is a much poorer catalyst of the CO2 reduction into CO than $Fe^{I/0}$TDHPP (the standard potential of $Fe^{I/0}$TDMPP is more negative than that of $Fe^{I/0}$TDHPP), and thus that the presence of the ortho substituents is of capital importance to the catalytic performance of the electrochemical cell of the invention.

Results

Figure 6:
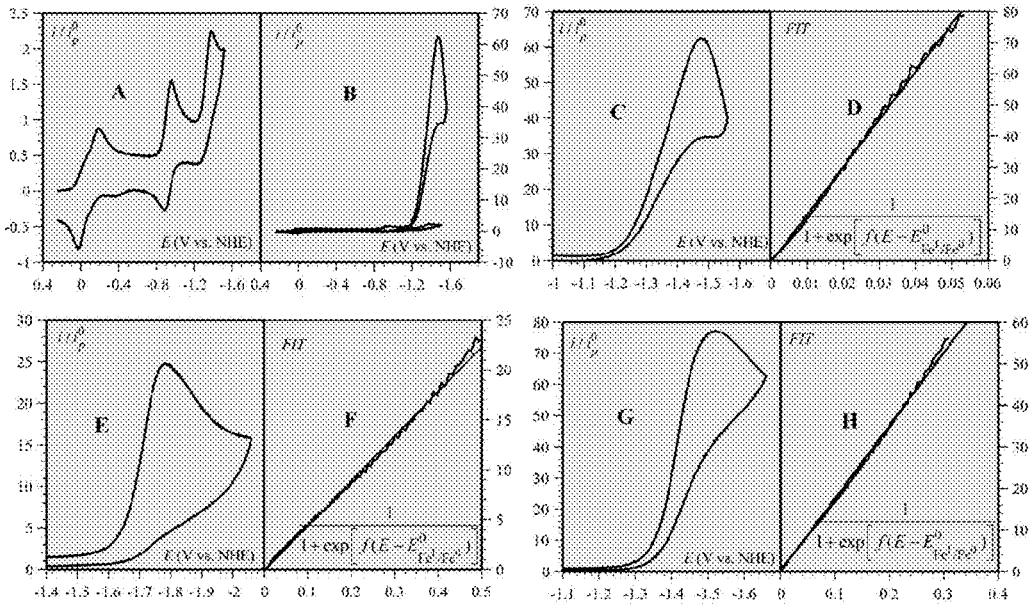
FIG. 6: Results of Cyclic voltammetry (intensity in μA as a function of E vs NHE in V) in DMF+0.1 M n-$Bu_4NPF_6$ electrolyte solution at 0.1 V/s of 1 mM of the three iron porphyrins Fe-TPP, Fe-TDMPP and FeTDHPP after normalization to the $Fe^{II}/Fe^{I}$ peak current, $i_p^0$. a: FeTDHPP+2 M $H_2O$. b: FeTDHPP+2 M $H_2O$ in the presence (upper trace) and absence (lower trace) of 0.23 M $CO_2$. c: FeTDHPP+2 M $H_2O$ in the presence of 0.23 M $CO_2$. e: FeTDMPP+2 M $H_2O$ in the presence of 0.23 M $CO_2$. g: FeTPP+3 M PhOH in the presence of 0.23 M $CO_2$. d, f, h: foot-of the-wave analyses of the voltammograms in c, e, g, respectively.

The results obtained in this way for FeTDHPP are shown in FIG. 6.

Figure 4:
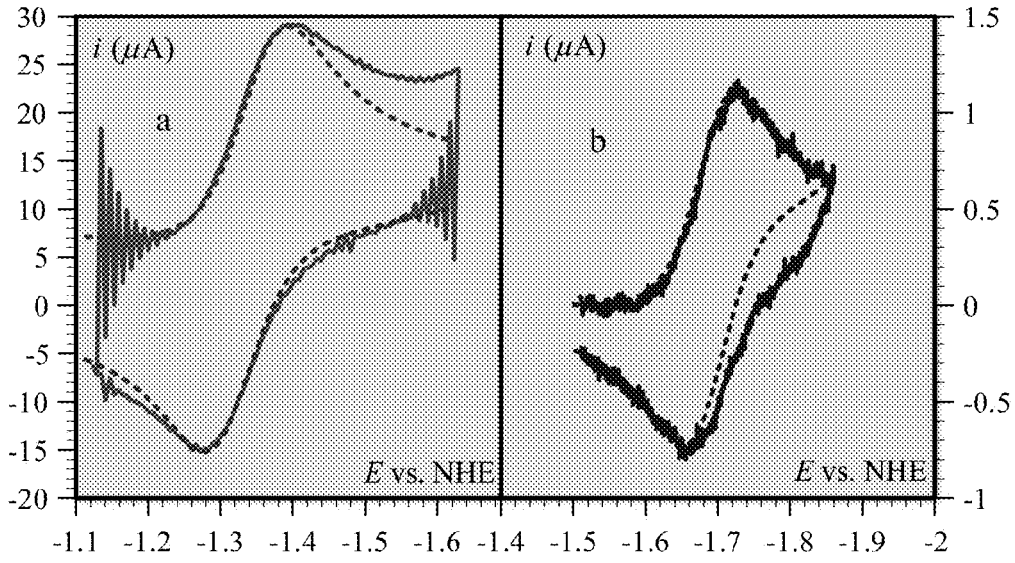
FIG. 4: Results of Cyclic voltammetry (intensity in μA as a function of E vs NHE in V) of 1 mM $Fe^{I}$TDHPP and $Fe^{I}$TDMPP in DMF+0.1 M n-$Bu_4NPF_6$+2 M $H_2O$. Full line: experiment; dashed lines simulation. a: at 70 V/s on a Hg microelectrode. b: 2 V/s on a glassy carbon electrode.

In the absence of $CO_2$, $Fe^{III}$TDHPP shows three waves, in DMF, corresponding successively to the $Fe^{III}/Fe^{II}/Fe^{I}/Fe^{0}$ redox couples (FIG. 6*a*). Catalysis takes place at the most negative wave, meaning that the catalyst is the iron(0) complex. In the absence of $CO_2$, the $Fe^{I}/Fe^{0}$ wave is not quite reversible at the slow scan rate, 0.1 V/s, where the catalytic experiments are run. Raising the scan rate allows the determination of the $Fe^{I}/Fe^{0}$ standard potential, $E_{cat}{}^0$=−1.333 V vs. NHE (FIG. 4). Introduction of $CO_2$ results in a 60-fold increase of the current at the level of the $Fe^{I}/Fe^{0}$ wave, (FIG. 6*b*) indicating a fast catalytic reaction.

Prolonged Electrolysis

Figure 5:
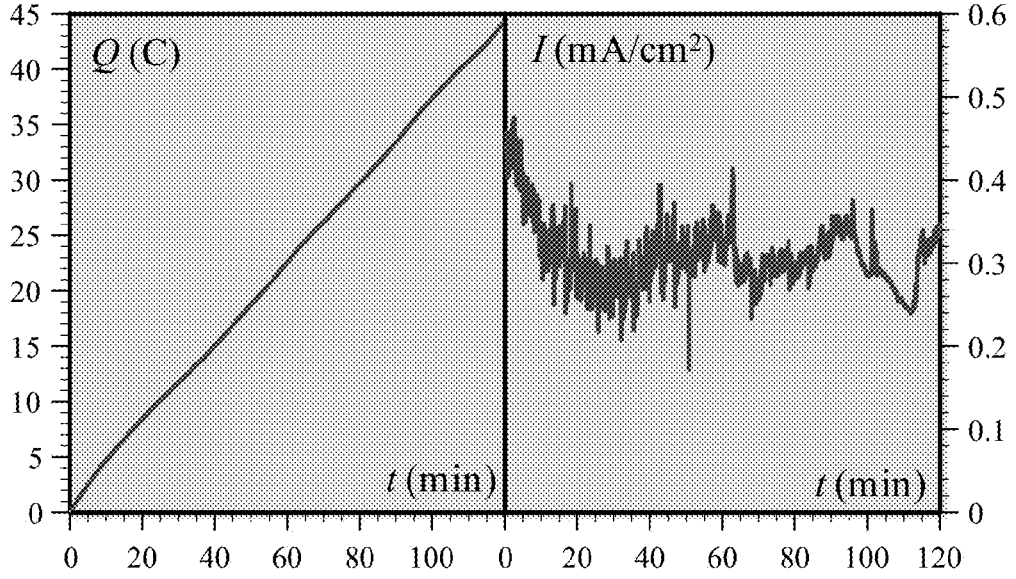
FIG. 5: Left: charge passed during electrolysis (Q in Coulomb (C) as a function of time in min). Right: current density over time (current density in $mA/cm^2$ as a function of time in min). These results are obtained for example 3.

A solution of 1 mM FeTDHPP in DMF+2 M $H_2O$ is electrolyzed at −1.16 V vs. NHE on a 20 $cm^2$ carbon crucible as electrode over 2 h. 43 C are transferred corresponding to an averaged current density of 0.31 mA/$cm^2$ (FIG. 5). CO is the main product and detection of gas in the headspace after 1 h and 2 h electrolysis leads to a faradaic yield of 94% and 6% of $H_2$.

This corresponds to log TOF=3.5 at 0.466 V overpotential. The catalyst is also remarkably stable: twenty-five million turnovers (TON 25 millions) were achieved after 4 hours of electrolysis at this potential, with no significant degradation of the iron complex.

Example 4

Comparison of the Efficiency of Different Catalysts

Correlation between turnover frequency and overpotential for the series of $CO_2$-to-CO electroreduction catalysts listed in Table 1.

TABLE 1

Catalysis of $CO_2$ reduction into CO. Correlation between turnover frequency and overpotential for the series of catalysts listed.

| Solvent $E_{CO_2/CO}^0$ V vs NHE | Catalyst | $E_{cat}^0$ (V vs. NHE) | η (V) | log TOF | log $TOF_0$ | Ref |
|---|---|---|---|---|---|---|
| DMF + 2M $H_2O$ −0.690 | $Fe^0$TDHPP | −1.333 | 0.41-0.56 | 2.3-4.2 | −4.6 | Present invention |
| | $Fe^0$TDMPP | −1.69 | 0.89-0.99 | 1.3-2.5 | −13.9 | / |
| | Re(bipy)$(CO)_3$ | −1.25 | 0.57 | 3.3 | −5.8 | 21 |
| DMF + $HBF_4$ −0.260* | {m-(triphos)$_2$-[Pd($CH_3CN$)$_2$}} | −0.76 | 0.80 | 0.67 | −7.5 | 22 |
| $CH_3CN$ + 5% $H_2O$ −0.650 | 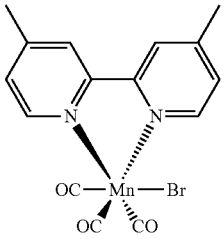 | −1.16 | 0.51 | −0.05 | −8.4 | 23 |
| $CH_3CN$ −0.650 | 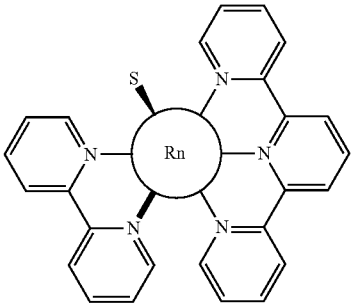 | −1.30 | 0.87 | 1.5 | −9.5 | 24 |
| | 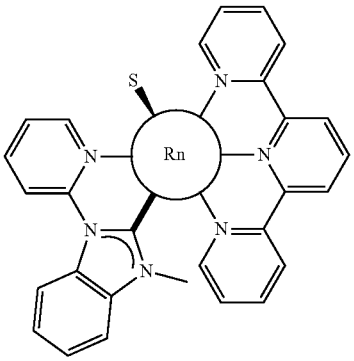 | −1.25 | 0.81 | 1.5 | −8.8 | |
| 1:4 $H_2O$ $CH_3CN$ −0.650 | 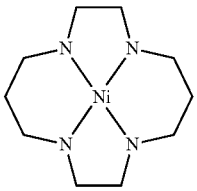 | −1.30 | 0.55 | 2.2 | −7.1 | 15 |

*: the large change in $E_{CO_2/CO}^0$ is due to the presence of a strong acid, $HBF_4$, much stronger than ($CO_2$ + $H_2O$).

Catalysts 21-24 and 15 and measurements have been previously described in : Hawecker et al. J. Chem. Soc. Chem. Commun. 1984, 328 (6); Raebiger et al. Organometallics. 2006, 3345 (25); Bourrez et al, Angew. Chem. Int. Ed. 2011, 9903 (50); Chen et al, Chem. Commun. 2011, 12607-12609 (47) and Froehlich et al. Inorg. Chem. 2012, 3932 (51).

Figure 7:
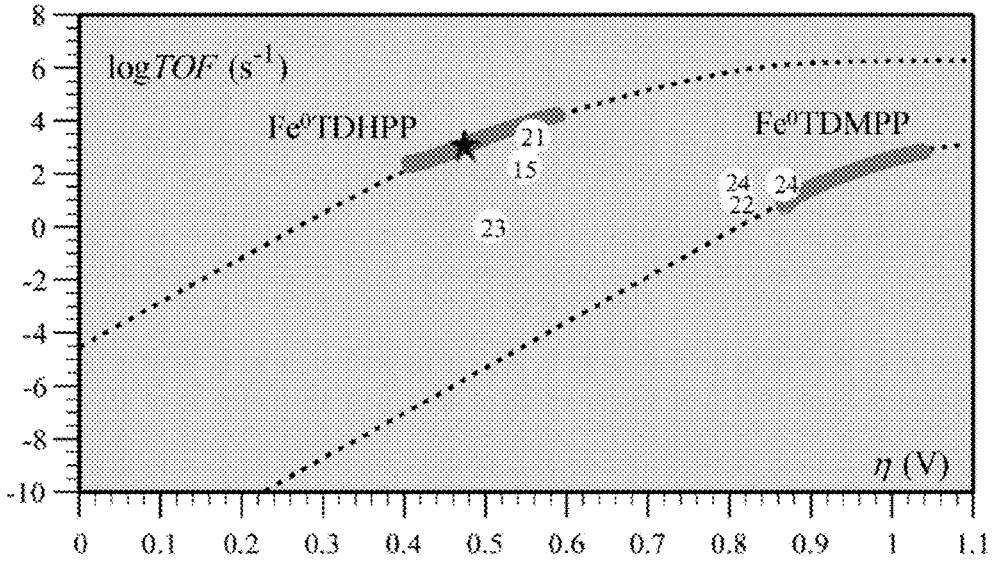
FIG. 7: Correlation between turnover frequency and overpotential (Log(TOF) as a function of η in V) for the series of $CO_2$-to-CO electroreduction catalysts listed in Table 1. Thick gray segments: TOF values derived from "foot-of-the-wave-analysis" of the cyclic voltammetric catalytic responses of $Fe^{I/0}$TDHPP and $Fe^{I/0}$TDMPP in the presence of 2 M $H_2O$. Dashed lines: Tafel plots for $Fe^{0}$TDHPP (top) and $Fe^{I/0}$TDMPP (bottom). Also shown are TOF and η values from preparative-scale experiments: star indicates $Fe^{0}$TDHPP (present invention), circled numbers represent the published references for other catalysts specified in Table 1 of example 4.

In FIG. 7, the thick gray segments represent the TOF values derived from an analysis of the cyclic voltammetric catalytic responses of $Fe^{I/0}$TDHPP and $Fe^{I/0}$TDMPP in the presence of 2 M $H_2O$ using a methodology developed in *J. Am. Chem. Soc.* 134, 11235-11242 (2012), the content of which is incorporated here in its entirety (see example 4). Indeed it has been shown that turnover frequency and overpotential are in fact linked. The dashed lines represent the log TOF-η plots for $Fe^0$TDHPP (top) and $Fe^0$TDMPP (bottom). Also shown are TOF and η values from preparative-scale experiments: star indicates $Fe^0$TDHPP (this invention), circled numbers the published references for other catalysts specified in Table 1.

For such molecular catalytic reactions, the catalyst is a well-defined molecule with, on defined conditions, a well-defined standard potential, turnover frequency and overpotential (see *J. Am. Chem. Soc.* 134, 11235-11242 (2012), the content of which is incorporated here in its entirety).

FIG. 7 thus demonstrates that modification of tetraphenylporphyrin (TPP) by introduction of phenolic groups in all ortho and ortho' positions of the TPP phenyl groups, leads to a considerable increase of catalytic activity. Indeed, FIG. 7 plots the log of the turnover frequency (turnover number per unit of time), TOF, against the overpotential, η (difference between the standard potential of the $CO_2$/CO couple and the operating electrode potential). The variation of the log TOF with the overpotential obtained from cyclic voltammetry of FeTDHPP in N,N'-dimethylformamide (DMF)+2M $H_2O$ in the presence of a saturating concentration of $CO_2$ (0.23 M) is shown as a thick gray segment.

There are three successive overpotential domains. At large η, when the electrode potential is set well above the catalyst standard potential, the TOF is governed solely by the catalytic rate constant, regardless of the overpotential. In the opposite situation ($E \gg E_{cat}^0$) log TOF is a linearly increasing function of the overpotential with slope f'=f/ln 10 (1/59.3 mV at 25° C.), with f=F/RT. In the transition between these two regimes, the system is controlled partly by the electron transfer and transport term, $k_S/\sqrt{D}$, ($k_S$ is the standard rate constant for electron transfer for the catalyst couple and D is the diffusion coefficient of the catalyst) giving rise to a linearly increasing function of the overpotential with slope half the value in the preceding domain. With fast electron transfer catalysts, this intermediary zone tends to vanish.

The log TOF vs η correlation diagram in FIG. 7 provides the basis for a rational comparison of the performances of the various molecular catalysts reported so far for the electroreduction of $CO_2$ to CO. Construction of the diagram requires an estimation of the standard potential of the $CO_2$/CO couple, $E_{CO_2/CO}^0$, in the operating media, in order to assign a value to the overpotential in each case.

The star in FIG. 7 presents the results of a preparative scale $CO_2$ electrolysis using electrochemically generated $Fe^0$TDHPP as the catalyst (example 1).

The performances of the present $Fe^0$TDHPP catalyst with those of the other molecular catalysts reported in the literature in DMF and $CH_3CN$ as solvents may then be compared using the log TOF vs. η representation of FIG. 7.

The $Fe^0$TDHPP catalyst is slightly more efficient in terms of TOF (by a factor of ca 10) than the most efficient catalyst previously reported, all based on expensive and not widely available metals. Moreover the $Fe^0$TDHPP catalyst is stable (no degradation after 4 h of electrolysis) and leads to very high selectivity.

In addition, the catalytic properties of $Fe^0$TDMPP (catalyst [4]) in cyclic voltammetry were compared to those of $Fe^0$TDHPP (catalyst [3]) in order to highlight the essential role of the OH protons in the remarkable efficiency of the latter catalyst. FIGS. 6*e,f* show the catalytic $Fe^0$TDMPP wave (see FIG. 3 for cyclic voltammetry of $Fe^{III}$TDMPP in the absence and presence of $CO_2$) and the associated foot-of-the-wave analysis, which underlies the lower dashed line in FIG. 7. In the potentials domain examined, this catalyst gives rise to rather high TOF. However this activity comes at the cost of large overpotentials. The comparison made at the level of intrinsic properties as captured by $TOF_0$, shows that $Fe^0$TDMPP is a considerably poorer catalyst than $Fe^0$TDHPP by a factor of ca one billion.

This comparison highlights the crucial role of the phenolic protons in this venture. This is confirmed by the observation that the $Fe^{I/0}$TPP $CO_2$ catalytic wave increases with the addition of phenol in the solution. The enhanced FeTDHPP catalytic activity is thus related to the very high local concentration of phenolic protons. In this context, it is interesting to compare quantitatively the catalytic reactivities of FeTDHPP and of FeTPP in the presence of a high concentration of phenol. The catalytic response of FeTPP in the presence of 3 M phenol is shown in FIG. 6*g* together with the corresponding foot-of-the-wave analysis in FIG. 6*h*. The corresponding characteristics of this catalyst are $E_{cat}^0$=−1.41 V vs. NHE and $k_{cat}=2k[CO_2]=3.2\times10^4\ s^{-1}$. The latter figure is to be compared with the rate constant for FeTDHPP, $1.6\times10^6\ s^{-1}$, leading to an estimate that the eight phenolic OH groups in the molecule are comparable to a 150 M phenol concentration.

This comparative example demonstrates that the electrochemical cells of the invention using the compounds of formula (I) as catalysts for the reduction of $CO_2$ into CO have several unexpected advantages over the known catalysts of the prior art:

high TOF at moderate overpotential;

high stability;

high selectivity.

The invention claimed is:

1. Method comprising performing electrochemical reduction of $CO_2$ thereby producing CO gas, using the porphyrin of formula (I):

(I)

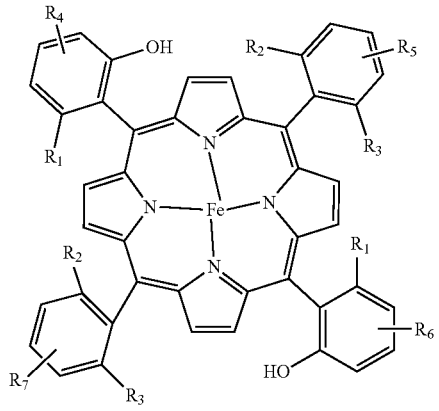

wherein

R1 represents OH, or $C_1$-$C_4$-alcohol,

R2, R3, R4, R5, R6 and R7 independently represent H, OH, or $C_1$-$C_4$-alcohol, and Fe represents either Fe(0), Fe(I), Fe(II) or Fe(III);

as a catalyst in an electrochemical cell for said electrochemical reduction of $CO_2$ into CO.

2. The method of claim 1, wherein the potential applied to the cathode is between −2.5 and −0.5 V versus NHE.

3. The method of claim 1, wherein the intensity applied to the cathode is between 2.0 and 5.0 $A/m^2$.

4. The method of claim 1, wherein R1 represents OH.

5. The method of claim 1, wherein R2 represents OH.

6. The method of claim 1, wherein R1, R2 and R3 represents OH.

7. The method of claim 1, wherein said porphyrin is

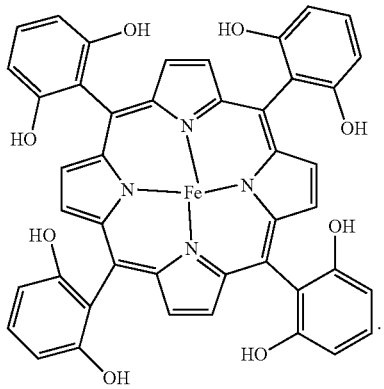

8. The method of claim 1, wherein the $CO_2$ is being reduced by the porphyrin of formula (I) with iron transition metal in the state Fe(0).

9. The method of claim 1, wherein the electrochemical reduction of $CO_2$ into CO is carried out at 1 bar of $CO_2$.

10. The method of claim 1, wherein the faradic yield in CO is of between 84% and 99%.

11. The method of claim 1, wherein no formation of formic acid or formate is observed.

* * * * *